US009334645B2

(12) United States Patent
Thrall et al.

(10) Patent No.: US 9,334,645 B2
(45) Date of Patent: May 10, 2016

(54) DEPLOYABLE PORTABLE SHELTER

(71) Applicant: University of Notre Dame du Lac, Notre Dame, IN (US)

(72) Inventors: Ashley P. Thrall, South Bend, IN (US); Angelene J. Dascanio, Los Olivos, CA (US); Chad P. Quaglia, East Bridgewater, MA (US)

(73) Assignee: University of Notre Dame du Lac, Notre Dame, IN (US)

( * ) Notice: Subject to any disclaimer, the term of this patent is extended or adjusted under 35 U.S.C. 154(b) by 0 days.

(21) Appl. No.: 14/820,659

(22) Filed: Aug. 7, 2015

(65) Prior Publication Data

US 2016/0010324 A1 Jan. 14, 2016

Related U.S. Application Data

(62) Division of application No. 14/604,211, filed on Jan. 23, 2015.

(60) Provisional application No. 61/943,142, filed on Feb. 21, 2014.

(51) Int. Cl.

| | |
|---|---|
| ***E04B 1/343*** | (2006.01) |
| ***E04B 1/344*** | (2006.01) |
| ***E04H 1/12*** | (2006.01) |
| *E04H 9/00* | (2006.01) |

(52) U.S. Cl.

CPC ..... *E04B 1/34384* (2013.01); *E04B 1/3445* (2013.01); *E04B 1/34336* (2013.01); *E04B 1/34357* (2013.01); *E04H 1/1205* (2013.01); *E04B 2001/34389* (2013.01)

(58) Field of Classification Search

CPC ..... E04B 1/34336; E04B 1/34357; E04B 1/34384; E04B 1/34321; E04B 1/3445; E04B 2001/34389; E04H 1/1205

USPC ..... 52/64, 69, 70, 71, 79.5, 745.02

See application file for complete search history.

(56) References Cited

U.S. PATENT DOCUMENTS

| | | | | | |
|---|---|---|---|---|---|
| 2,970,600 | A * | 2/1961 | Schultz | E04H 15/003 | 135/118 |
| 3,426,367 | A * | 2/1969 | Bradford | A47C 17/645 | 403/108 |
| 4,467,572 | A * | 8/1984 | Somers | A63H 33/008 | 16/225 |
| 5,060,426 | A * | 10/1991 | Jantzen | E04B 1/344 | 52/126.1 |
| 7,698,860 | B2 * | 4/2010 | Hockemeyer | E04F 15/0247 | 182/179.1 |
| 8,763,315 | B2 * | 7/2014 | Hartman | E04B 1/3445 | 52/71 |
| 9,016,001 | B2 * | 4/2015 | Heger | E04B 1/34357 | 52/79.5 |
| 2015/0218794 | A1 * | 8/2015 | Martyn | E04B 1/3441 | 52/79.5 |

* cited by examiner

*Primary Examiner* — Charles A Fox
*Assistant Examiner* — Joseph J Sadlon
(74) *Attorney, Agent, or Firm* — Greenberg Traurig, LLP

(57) ABSTRACT

A shelter has a packaged configuration and a deployed configuration. The shelter has four panels, each with four edges and two faces. The first and fourth panels have a rectangular shape, and the second and third panels have a quadrangle shape. The relationship of panel edge lengths and angles of the quadrangle shelter panels create a sturdy enclosure that is easy to erect, manipulate, and reconfigure. Furthermore, the shelter may be erected by rotating the panels into place via pivotal connections between the panels and optionally through the use of a lever arm.

10 Claims, 9 Drawing Sheets

DEPLOYABLE PORTABLE SHELTER

CROSS REFERENCE TO RELATED APPLICATION

This application is a divisional of U.S. patent application Ser. No. 14/604,211, entitled "Deployable Portable Shelter," filed Jan. 23, 2015, which claims priority to U.S. Provisional Patent Application No. 61/943,142, entitled "Air-Liftable, Modular, Rapidly Deployable Shelter," filed Feb. 21, 2014, the contents and disclosure of which are each hereby incorporated by reference in their entirety.

GOVERNMENT LICENSE RIGHTS

This invention was made with government support under W911QY-12-C-0128 awarded by the US Army Natick Soldier Research, Development and Engineering Center (NSRDEC). The government has certain rights in the invention.

FIELD OF THE DISCLOSURE

The present disclosure relates generally to a rigid wall shelter having both a packaged configuration and a deployed configuration, and more particularly to a rapidly deployable portable shelter.

BACKGROUND OF RELATED ART

A deployable shelter transforms from a smaller packaged state to a larger deployed state. Deployable shelters can be divided into two main groups: soft wall shelters and rigid wall shelters.

Soft wall shelters utilize a frame or skeletal structure to create the general supporting form of the shelter and a flexible cover stretched over the support structure to form a barrier. Examples of existing frame materials include wood, steel, aluminum, and fiberglass in the form of support poles, posts, or rails. Examples of existing flexible cover materials include fabric, vinyl, and animal skin. More generally, examples of existing soft wall shelters include tents and canopies.

As described in U.S. Pat. No. 8,602,044, tents of conventional, soft-sided construction are typically time-consuming to erect. For instance, U.S. Pat. No. 8,602,044 describes that tents with conventional internal frames require substantial effort by more than one person to place all the poles in position and then build a tent body around the pole structures.

As described in U.S. Pat. No. 3,368,575, some shelters require additional assembly and disassembly of the framework components (with the possibility of losing parts) and may require ropes, stakes, or other auxiliary devices to maintain them in an erected condition. Additionally, International Patent Application No. WO/2013/033819A1 describes large-scale collapsible fabric-covered structures, and typically the frames for such structures consist of multiple separate pieces which can become misplaced and are complicated to assemble, disassemble, and pack for shipment.

As described in U.S. Pat. No. 8,156,952, due to their temporary and portable nature, tent structures are often made of lightweight materials, which can lead to only marginally sturdy enclosures. U.S. Pat. No. 8,156,952 further describes that the fabrics of the tents can expand and shrink due to weather conditions or storage conditions.

Rigid wall shelters form a barrier from the outside environment through the use of rigid walls or panels. Examples of rigid-wall materials include wood, composites (e.g., carbon fiber or glass fiber reinforced polymer), brick, concrete, or layers of materials (e.g., sandwich panels). More generally, examples of existing rigid-walled shelters include buildings, houses, or containerized housing units (CHUs) such as mobile homes.

As described in U.S. Pat. No. 6,202,364, prefabricated structures are heavy to manipulate and often require large cranes which are expensive. U.S. Pat. No. 6,202,364, further describes that many of the prefabricated or other type home or building structures are constructed for permanent installation and cannot be easily dismantled and reassembled on another site.

As described in U.S. Pat. No. 8,622,066, due to their design and construction at least some of these portable shelters may require a significant amount of time and labor in order to properly set the shelter up for use, and to reconfigure the portable shelter for transportation when the shelter is no longer needed.

Finally, U.S. Patent Publication No. 2009/0014044 describes a folding shed including a first sidewall and a second sidewall. A first roof section is pivotally coupled with the first sidewall. A second roof section is pivotally coupled with the second sidewall. A foldable first end wall is pivotally coupled with the first sidewall, and the first end wall is pivotally coupled with the second sidewall. A foldable second end wall is pivotally coupled with the first sidewall, and the second end wall is pivotally coupled with the second sidewall. The first and second sidewalls, the first and second roof sections, and the first and second foldable end walls are configurable into a first position to define an interior of a shed. The first roof section is pivotally movable outwardly from the interior of the shed when the first and second sidewalls, the first and second roof sections, and the first and second foldable end walls are configured in the first position.

Deployable shelters are often used in situations where a temporary or seasonal shelter is required. Examples include emergency and disaster relief situations, athletic events, entertainment venues, and livestock transportation. Military soldiers are one of the largest user groups of deployable shelters, utilizing shelters in theater environments for soldiers, aircraft, vehicles, equipment, or any other suitable device. Such shelters range from tents carried by mobile foot soldiers to entire camps built of prefabricated, re-locatable buildings.

Accordingly, there is a need for a single deployable shelter solution that generally provides a sturdy enclosure that is relatively easy to erect, manipulate, and reconfigure as needed.

DETAILED DESCRIPTION

The following disclosure of example methods and apparatus is not intended to limit the scope of the description to the precise form or forms detailed herein. Instead the following description is intended to be illustrative so that others may follow its teachings.

The shortcomings of previous efforts by others in the field of this technology may be overcome and additional advantages may be provided through a shelter having a packaged configuration and a deployed configuration. Additional features and advantages may be realized through the techniques utilized in the present shelter. Other embodiments and aspects of the shelter are described in detail herein and are considered a part of the claimed shelter. For a better understanding of the shelter with advantages and features, refer to the description and to the drawings.

Figure 1:
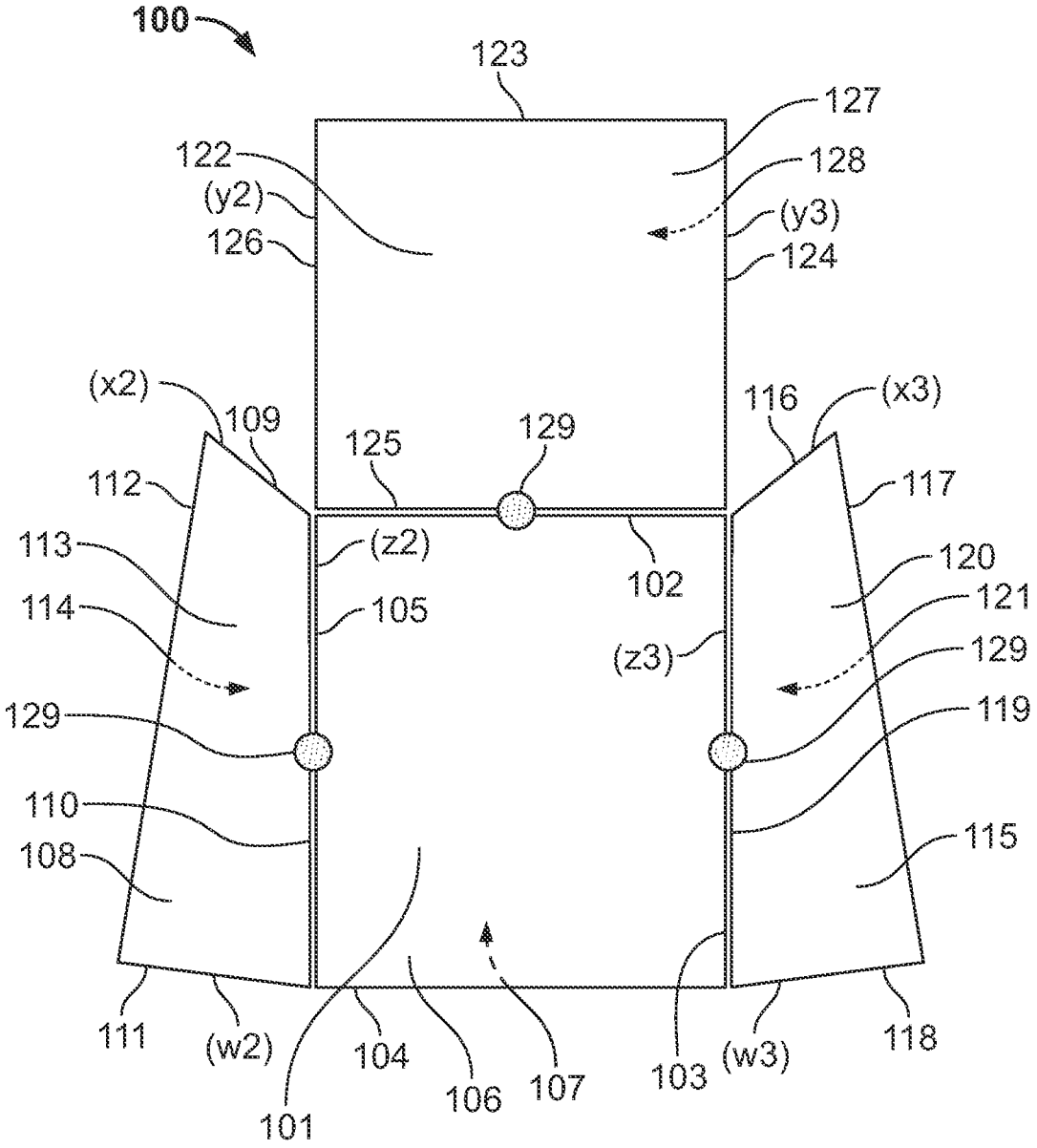
FIG. 1 is a plan view of an example shelter constructed in accordance with the teachings of the present invention in an open, non-deployed configuration.

Referring to the figures, wherein like numerals indicate like or corresponding parts throughout the several views, FIG. 1 illustrates a plan view of an example shelter 100 in a generally open, non-deployed configuration having a back wall, such as a first panel 101 having a first edge 102, a second edge (Z3) 103, a third edge 104, a fourth edge (Z2) 105, a first face 106, and a second face 107, a first wing wall such as a second panel 108 having a first edge (X2) 109, a second edge 110, a third edge (W2) 111, a fourth edge 112, a first face 113, and a second face 114, a second wing wall such as a third panel 115 having a first edge (X3) 116, a second edge 117, a third edge (W3) 118, a fourth edge 119, a first face 120, and a second face 121, and a roof such as a fourth panel 122 having a first edge 123, a second edge (Y3) 124, a third edge 125, a fourth edge (Y2) 126, a first face 127, and a second face 128.

Figure 6A:
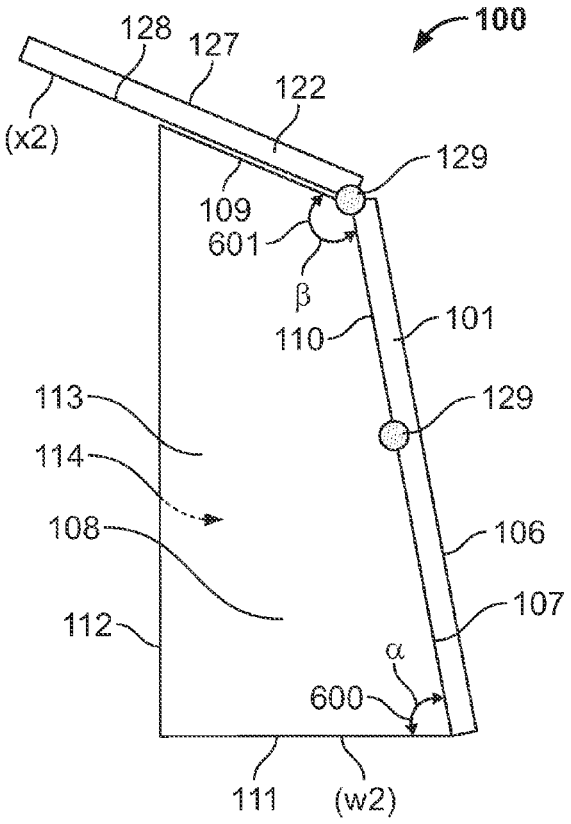
FIGS. 6A and 6B are opposite side elevation views showing the example shelter in the deployed configuration.
Figure 6B:
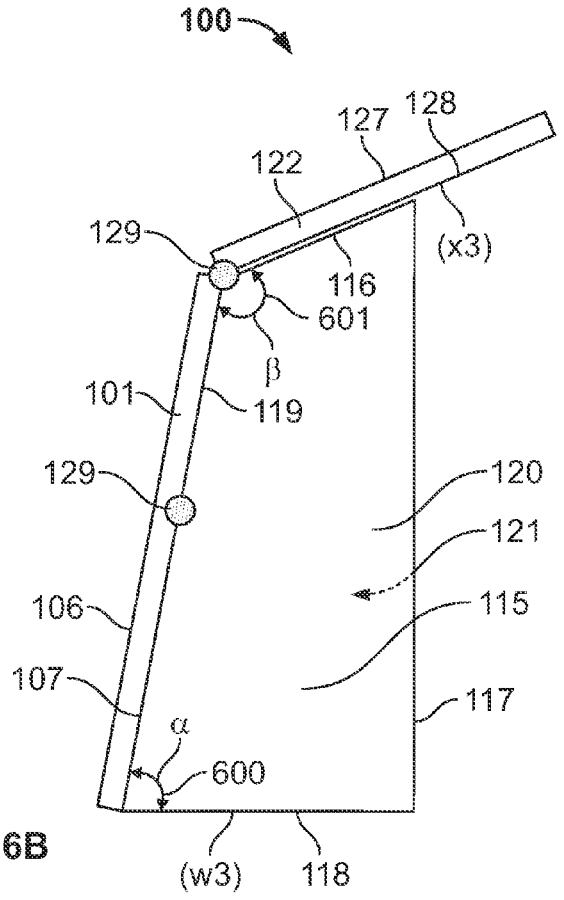

As best illustrated in FIGS. 6A and 6B, an angle alpha (a) 600 is formed between the second edge 110 and third edge (W2) 111 of the second panel 108 and the third edge (W3) 118 and fourth edge 119 of the third panel 115. Similarly, an angle beta (β) 601 is formed between the first edge (X2) 109 and second edge 110 of the second panel 108 and first edge (X3) 116 and fourth edge 119 of the third panel 115.

In the present disclosure, the angle alpha (α) is generally greater than zero degrees and generally less than or equal to 90 degrees, as provided in Equation (1). Similarly, the angle beta (β) is generally greater than 180 degrees minus alpha (180°−α) and generally less than 180 degrees, as provided in Equation (2). It will be appreciated by one of ordinary skill in the art that other sizes of the shelter 100 will satisfy the conditions for the angles alpha (α) and beta (β). In one example, the first edge (X2) 109 of the second panel 108 has a length generally greater than zero and generally less than or equal to a length of the fourth edge (Y2) 126 of the fourth panel 122, as provided in Equation (3). Further in one example, the first edge (X3) 116 of the third panel 115 has a length generally greater than zero and generally less than or equal to a length of the second edge (Y3) 124 of the fourth panel 122, as provided in Equation (4). In one example, the third edge (W2) 111 of the second panel 108 has a length generally greater than zero and generally less than or equal to a length given by the equation (Z2) cos (α)+(Y2) cos (α+β−180°), as provided in Equation (5). Further in one example, the third edge (W3) 118 of the third panel 115 has a length generally greater than zero and generally less than or equal to a length given by the equation (Z3) cos (α)+(Y3) cos (α+β−180°), as provided in Equation (6).

$$0<\alpha\leq 90° \quad (1)$$

$$180°-\alpha<\beta<180° \quad (2)$$

$$0<X2\leq Y2 \quad (3)$$

$$0<X3\leq Y3 \quad (4)$$

$$0\,W2\leq(Z2)\cos(\alpha)+(Y2)\cos(\alpha+\beta-180°) \quad (5)$$

$$0\,W3\leq(Z3)\cos(\alpha)+(Y3)\cos(\alpha+\beta-180°) \quad (6)$$

The shape of the panels can include any quadrilateral such as, for example, square, rectangular, trapezoidal, rhombus, or other suitable shape. Panel materials can include, for example, metal, composite (such as carbon fiber or glass fiber reinforced polymer), wood, or other suitable material. Panels can be of a solid construction of a single material or a sandwich construction of multiple layers of material. In the disclosed example, the first and fourth panels have a rectangular shape and the second and third panels have a quadrangle shape. A hinge, such as a pivot connection 129 connects the second panel 108 to the first panel 101, the third panel 115 to the first panel 101, and the fourth panel 122 to the first panel 101. Such a pivot connections can include, for example, a single hinge or a plurality of hinges.

Figure 2:
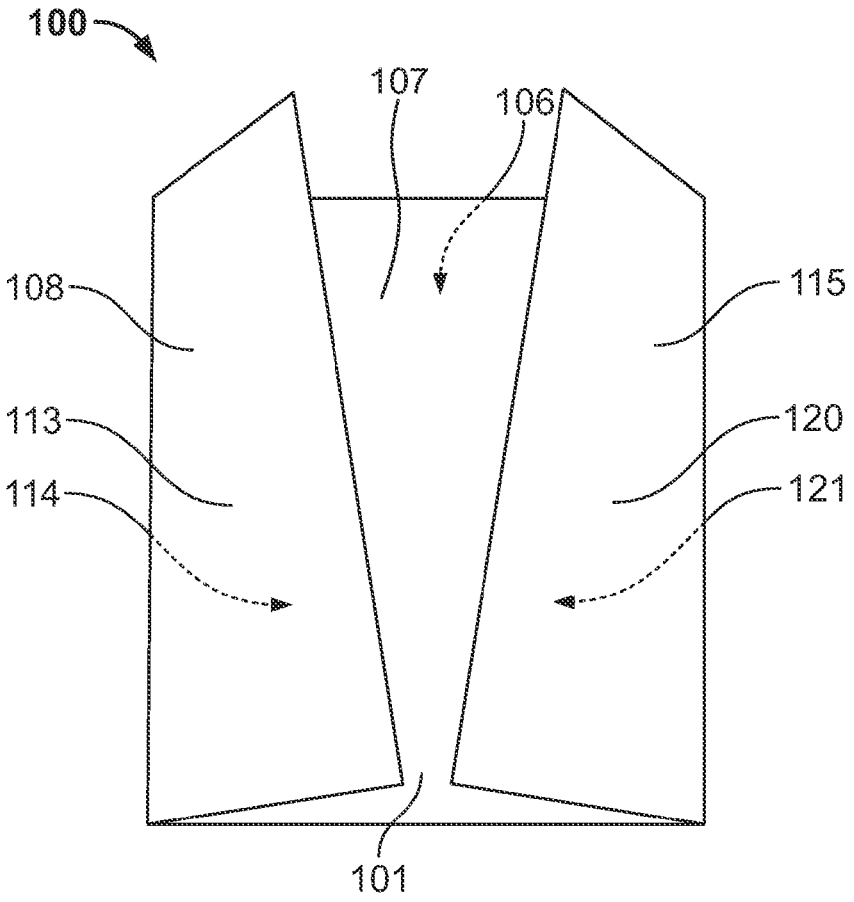
FIG. 2 is a plan view showing the example shelter in a packaged configuration.

Referring to FIG. 2 there is illustrated a plan view of one example of the shelter 100 in a generally closed packaged configuration having the second face 114 of the second panel 108 generally parallel and adjacent to the second face 107 of the first panel 101, and the second face 121 of the third panel 115 generally parallel and adjacent to the second face 107 of the first panel 101. Other variations of packaged configurations are possible by rotating the panels about their respective pivot connections in any desired order. In one example, the packaged configuration of the shelter has a periphery within surface area dimensions of a standard military pallet. For instance, one example packaged configuration of the shelter has a periphery within surface area dimensions of a 463L pallet, which extends approximately 88 inches by approximately 108 inches.

Figure 3:
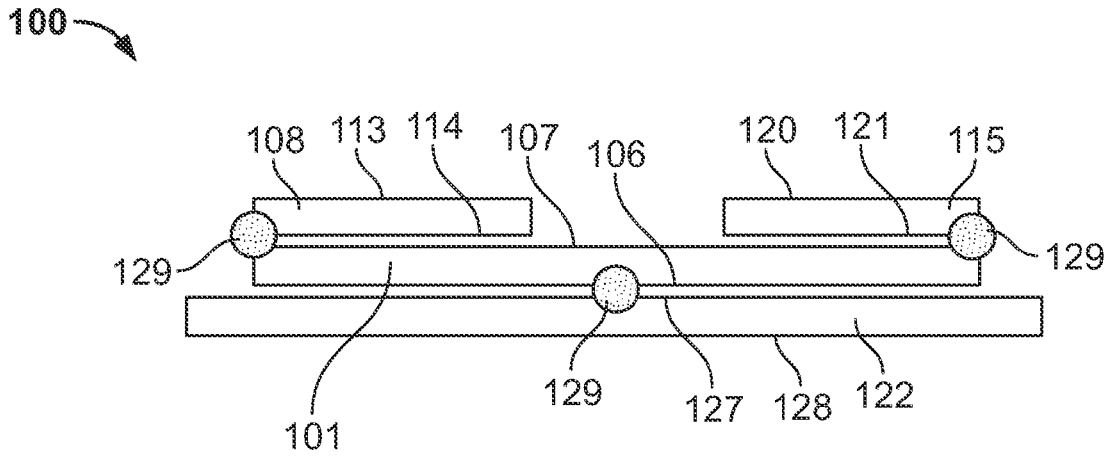
FIG. 3 is an elevation view showing the example shelter in a packaged configuration.

Referring to FIG. 3 there is illustrated a elevation view of one example of the shelter 100 in a generally closed packaged configuration having the second face 114 of the second panel 108 generally parallel and adjacent to the second face 107 of the first panel 101, the second face 121 of the third panel 115 generally parallel and adjacent to the second face 107 of the first panel 101, and the first face 127 of the fourth panel 122 generally parallel and adjacent to the first face 106 of the first panel 101. In the illustrated example, the fourth panel 122 is generally wider than the first panel 101.

Figure 4:
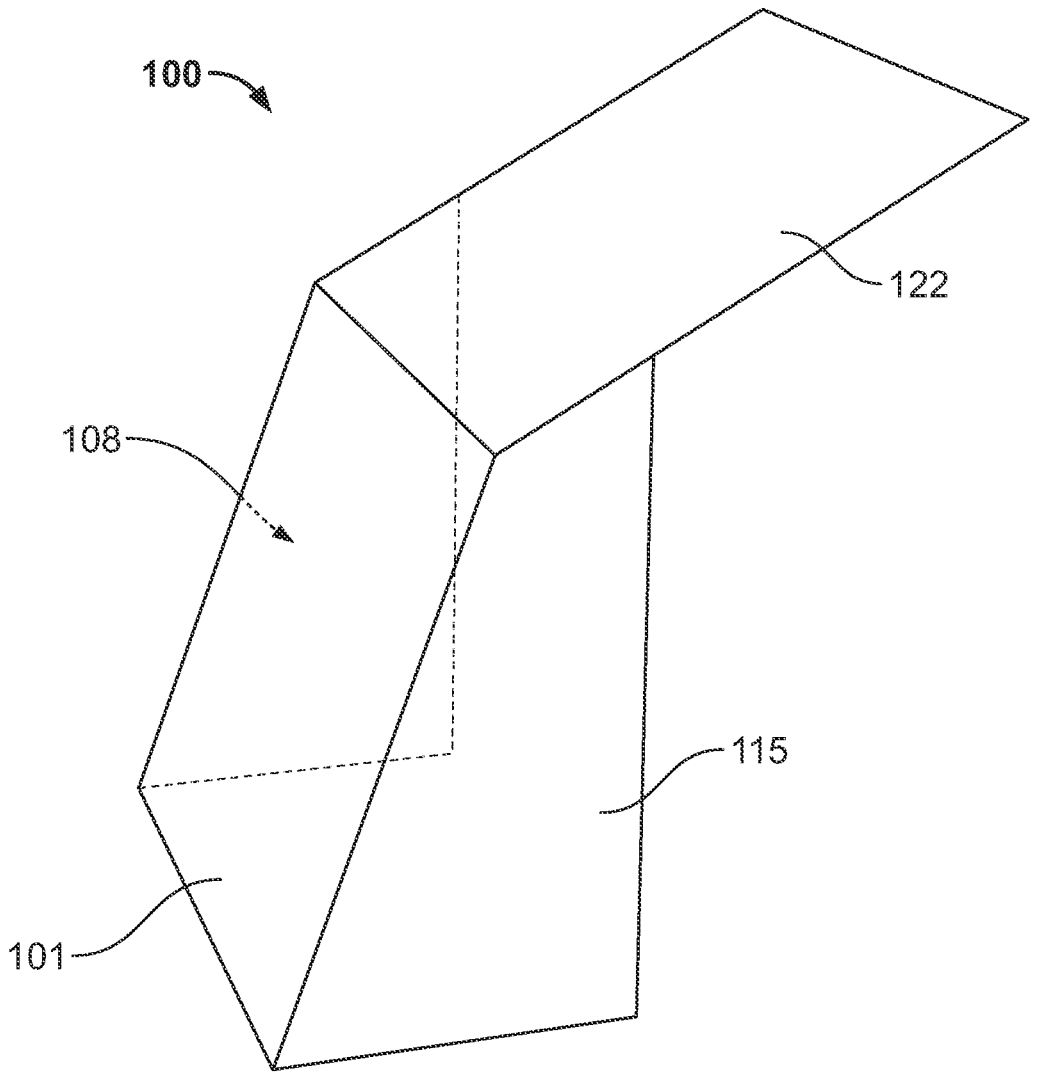
FIG. 4 is a perspective view showing the example shelter in a deployed configuration.

Referring to FIG. 4 there is illustrated a perspective view of one example of the shelter 100 in a generally deployed configuration of the first panel 101, second panel 108, third panel 115, and fourth panel 122.

Figure 5:
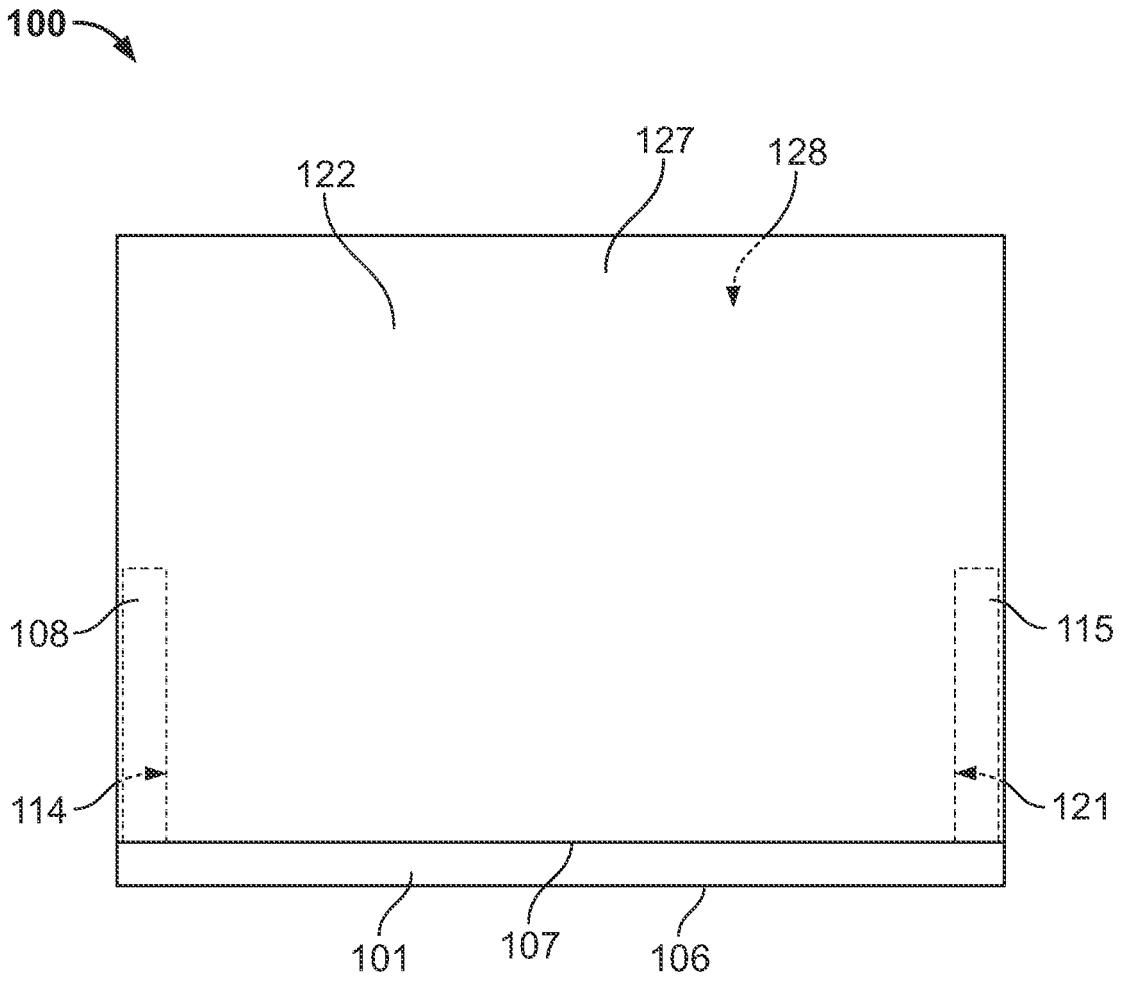
FIG. 5 is a plan view showing the example shelter in the deployed configuration.

Turning now to FIG. 5 there is illustrated a plan view of one example of the shelter 100 in a generally deployed configuration having the second face 114 of the second panel 108 generally perpendicular to the second face 107 of the first panel 101, the second face 121 of the third panel 115 generally perpendicular to the second face 107 of the first panel 101, and the second face 128 of the fourth panel 122 generally perpendicular to the second face 114 of the second panel 108 and generally perpendicular to the second face 121 of the third panel 115. Other variations of deployed configurations are possible by rotating the panels about their respective pivot connections in any desired order. Additionally, the panels may engage with one another at any suitable angle.

Referring to FIG. 6A-B there are illustrated opposite side elevation views of the example shelter 100 in a generally deployed configuration having the angle alpha (α) 600 formed between the second edge 110 and third edge (W2) 111 of the second panel 108 and the third edge (W3) 118 and fourth edge 119 of the third panel 115. The angle beta (β) 601 is formed between the first edge (X2) 109 and second edge 110 of the second panel 108 and first edge (X3) 116 and fourth edge 119 of the third panel 115.

Figure 7:
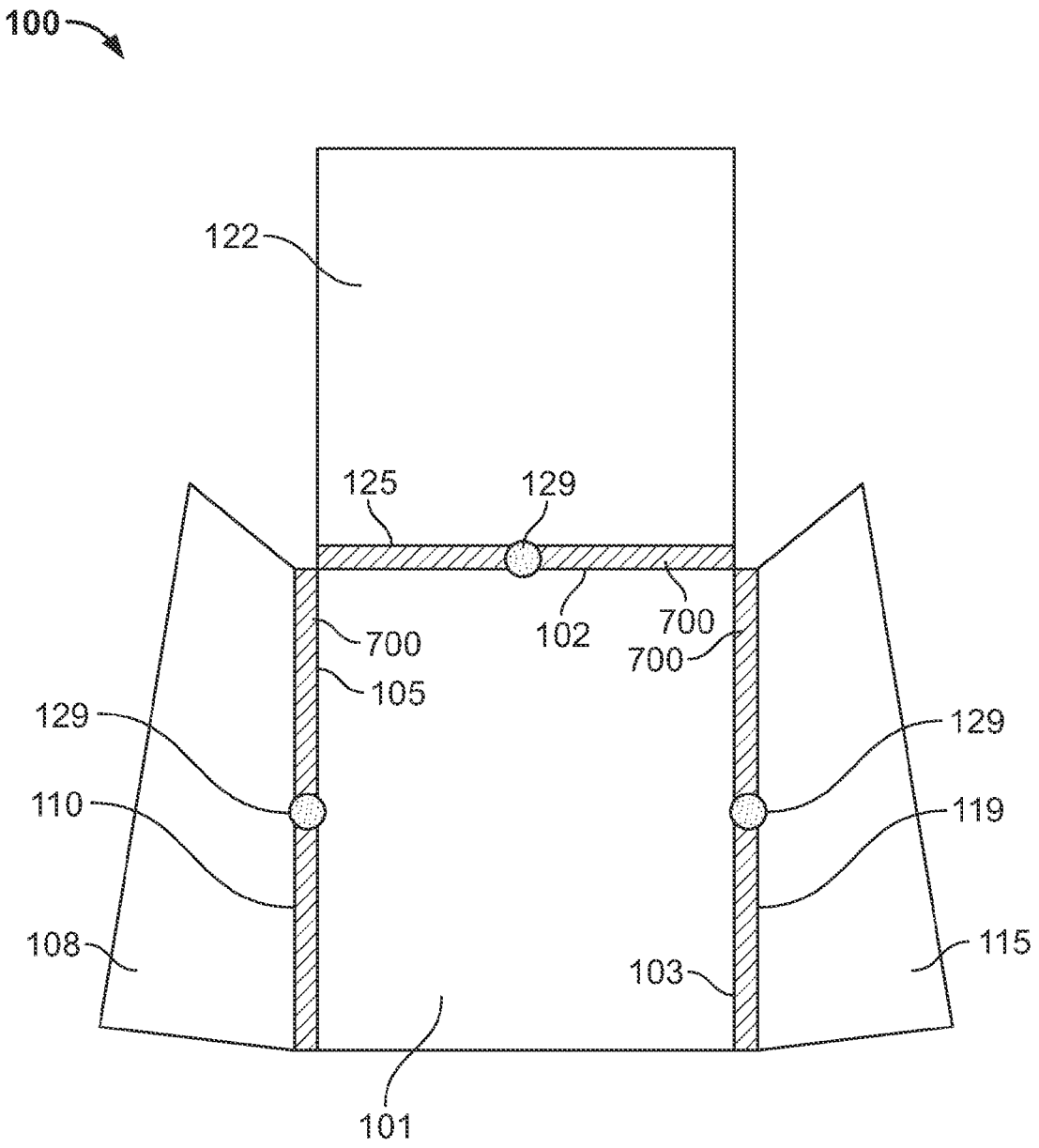
FIG. 7 is a plan view showing the example shelter in the open, non-deployed configuration including insulation material between the panels.
Figure 8A:
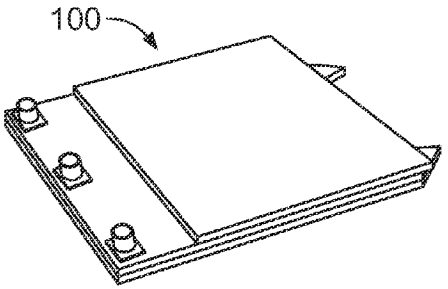
FIGS. 8A-8F together illustrate one example of a general method of deploying the example shelter.
Figure 8B:
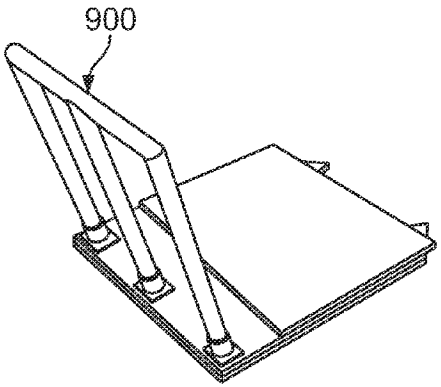
Figure 8C:
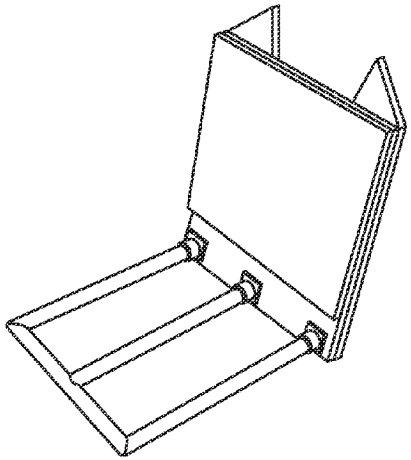
Figure 8D:
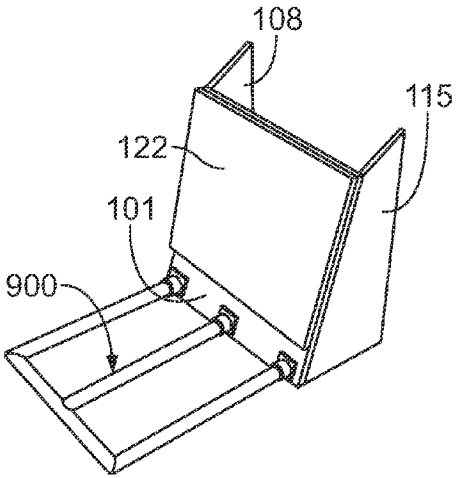
Figure 8E:
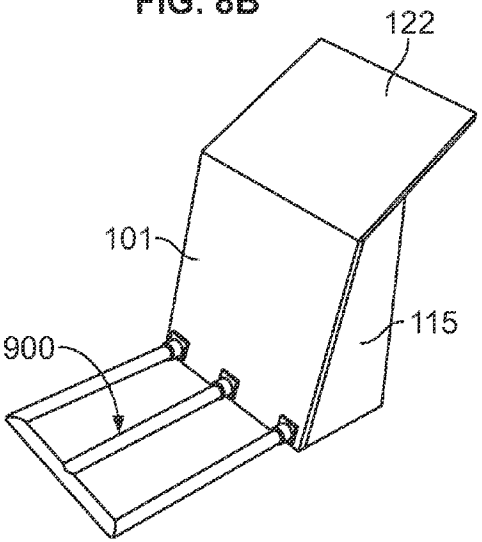
Figure 8F:
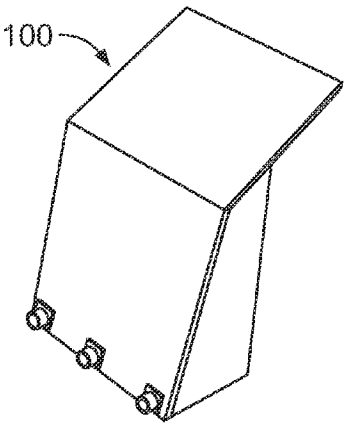

Referring to FIG. 7 there is illustrated a plan view of the example shelter 100 in a generally open packaged configuration having a strip of insulation material 700 adjacent to the second edge 110 of the second panel 108 and the fourth edge (Z2) 105 of the first panel 101, a strip of insulation material 700 adjacent to the fourth edge 119 of the third panel 115 and the second edge (Z3) 103 of the first panel 101, and a strip of insulation material 700 adjacent to the third edge 125 of the fourth panel 122 and first edge 102 of the first panel 101. Such insulation material can include, for example, spray foam, duct tape, weather-stripping, foam, putty, a gasket, or any other suitable material. Insulation material can be applied on site after deployment of the shelter 100. In one example, insulation material can be applied to close any gap formed between panel edges. Other insulation methods can include, for example, covering the shelter 100 with canvas, tarpaulin fabric, or any other suitable material.

Referring to FIG. 8A-8F there is illustrated one example of a general method of deploying the shelter 100 from a packaged configuration to a deployed configuration by providing the shelter 100 (FIG. 8A), rotating the shelter 100 about an axis of rotation defined by the third edge 104 of the first panel 101 in contact with a supporting surface (FIG. 9B, 9C), rotating the second panel 108 about an axis of rotation defined by the second edge 110 of the second panel 108 and the fourth edge (Z2) 105 of the first panel 101 to extend from the first panel 101 (FIG. 9D), rotating the third panel 115 about an axis of rotation defined by the fourth edge 119 of the third panel 115 and the second edge (Z3) 103 of the first panel 101 to extend from the first panel 101 (FIG. 9D), and rotating the fourth panel 122 about an axis of rotation defined by the third edge 125 of the fourth panel 122 and the first edge 102 of the first panel 101 to rest upon the wing walls (FIG. 9E, 9F). Other variations of deployed configurations are possible by rotating the panels about their respective pivot connections in any desired order. Additionally, the panels may engage with one another at any suitable angle.

In the present example, the step of rotating the shelter 100 about an axis of rotation is further defined as operatively connecting a lever arm 900 in a generally perpendicular position to the first face 106 of the first panel 101 and adjacent to the third edge 104 of the first panel 101 and providing a force to the lever to overcome the self-weight of the shelter. In one example, the lever arm 900 may include a counterweight, or other suitable attachment for assisting in the erection of the shelter. Rotating the shelter 100 during deployment can be accomplished by any suitable method, including for example, via a cable(s) or by hand. The lever arm 900 materials can include, for example, metal, wood, composite, or any other suitable material.

Figure 9:
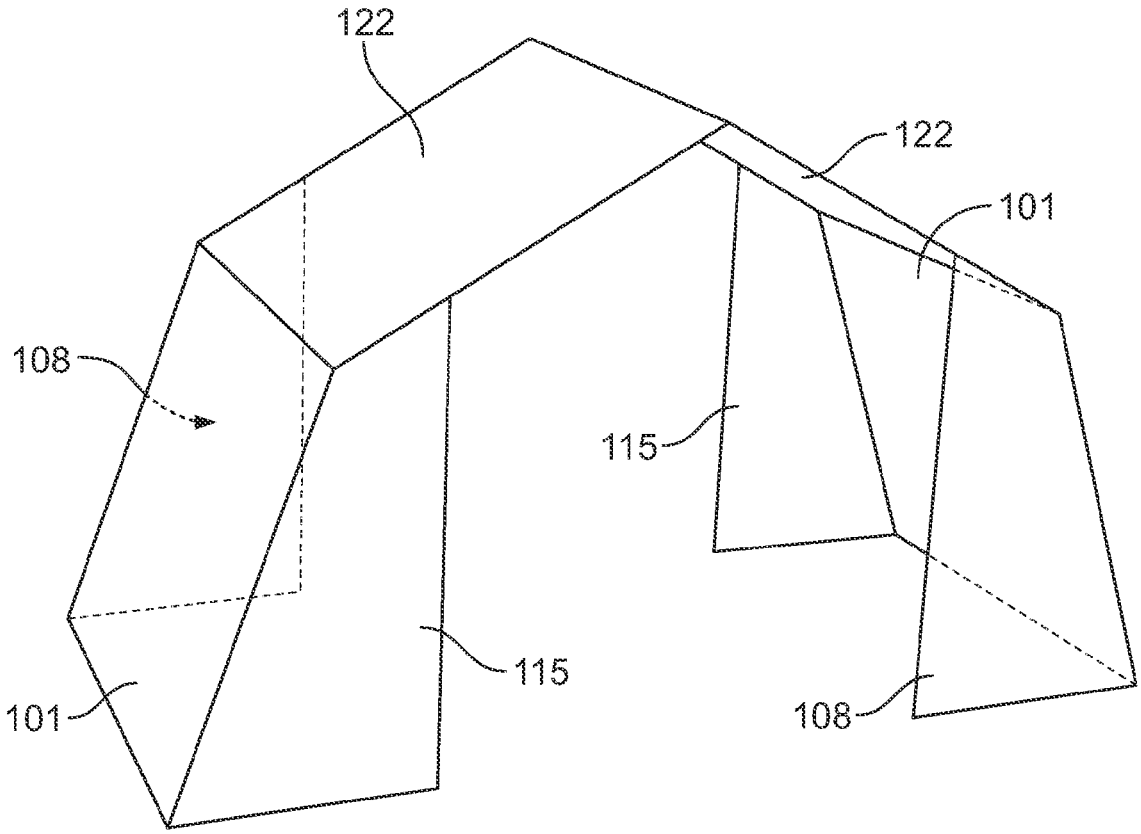
FIG. 9 is a perspective view showing two of the example shelters mated to form an example shelter compound.

Referring to FIG. 9 there is illustrated one example of two shelters 100 in a configuration to create a generally larger shelter compound. It will be appreciated by one of ordinary skill in the art that other panels and/or configurations may be utilized. For example, in one configuration, there may be enclosure panels utilized to construct a shelter having an enclosed space.

Figure 10:
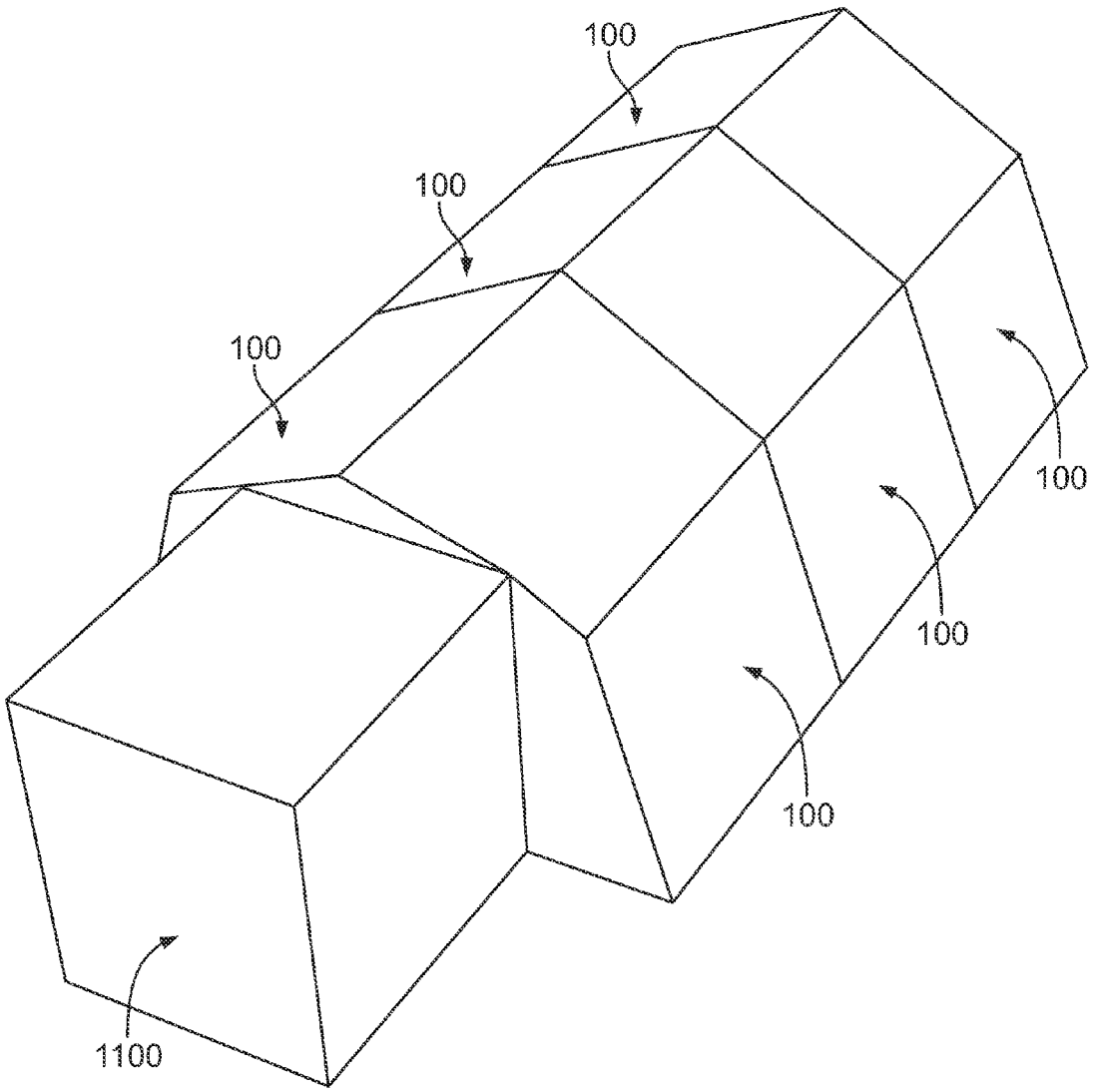
FIG. 10 is a perspective view of a plurality of shelters interfacing with a container to create an example of a larger shelter compound.

Referring to FIG. 10 there is illustrated one example of a plurality of shelters 100 interfacing with a container 1100 to create a generally larger shelter compound. In one example, the container 1100 can be a shipping container, building, home, shelter, or other suitable container. For instance, in one example, the container 1100 may be a Tricon modular container available from Charleston Marine Containers, Inc., Charleston, S.C.

Obviously, many modifications and variations of the present technology are possible in light of the above teachings and may be practiced otherwise than as specifically described while within the scope of the claims. For instance, although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A method of deploying a shelter from a packaged configuration to a deployed configuration, the method comprising:

providing a shelter having a packaged configuration and a deployed configuration, the shelter comprising:

a back wall having a first face surface, a second face surface, a bottom portion and a top portion;

a roof panel pivotally coupled to the top portion of the back wall, the roof panel being pivotal to lie substantially parallel with the first face surface of the back wall when in the packaged configuration;

a first wing wall pivotally coupled to a first side of the back wall, the first wing wall having a generally quadrangle shape and the first wing wall being pivotal to lie substantially parallel with the second face surface of the back wall when in the packaged configuration; and a second wing wall pivotally coupled to a second side of the back wall opposite the first wing wall and having a generally quadrangle shape, the second wing wall being pivotal to lie substantially parallel with the second face surface of the back wall when in the packaged configuration;

operably connecting a lever arm to extend upwardly from the back wall in a generally perpendicular position relative to the shelter in the packaged configuration;

rotating the shelter about a bottom portion of the back wall by providing a force to the lever arm to cause the lever arm to impart a rotation to the shelter to rotate the shelter from a generally horizontal orientation into an upstanding orientation;

rotating the first wing wall to extend from the back wall;

rotating the second wing wall to extend from the back wall;

rotating the roof panel to be supported by the first and second wing wall such that the roof panel is supported directly by the first and second wing wall.

2. A method as recited in claim 1, further comprising operably connecting the shelter together with a second shelter to form a shelter compound.

3. A method as recited in claim 2, wherein the second shelter comprises a back wall, a first wing wall, a second wing wall, and a roof panel, the method further comprising operably connecting the shelter and the second shelter by at least one of their respective back walls, wing walls, or roof panels.

4. A method as recited in claim 1, wherein the lever arm is operably connected to the bottom portion of the back wall.

5. A method as recited in claim 1, wherein the lever arm is operably connected to the bottom portion of the first face surface of the back wall.

6. A method of deploying a shelter comprising a back wall, a roof panel pivotally coupled to the top portion of the back wall, a first quadrangle shaped wing wall pivotally coupled to a first side of the back wall, and a second quadrangle shaped wing wall pivotally coupled to a second side of the back wall, from a packaged configuration to a deployed configuration, where the roof panel, the back wall, and the first and second wing walls are substantially parallel in the packaged configuration, the method comprising:

operably connecting a lever arm to extend upwardly from the back wall in a generally perpendicular position relative to a bottom portion of the shelter;

rotating the shelter about a bottom portion of the back wall by providing a force to the lever arm to cause the lever arm to impart a rotation to the back wall and the attached first and second wing walls and the roof panel to rotate the back wall from a generally horizontal orientation into an upstanding orientation;

rotating the first wing wall to extend from the back wall;

rotating the second wing wall to extend from the back wall;

rotating the roof panel to be supported by the first and second wing wall such that the roof panel is supported directly by the first and second wing wall.

7. A method as recited in claim 6, further comprising operably connecting the shelter together with a second shelter to form a shelter compound.

8. A method as recited in claim 7, wherein the second shelter comprises a back wall, a first wing wall, a second wing wall, and a roof panel, the method further comprising operably connecting the shelter and the second shelter by at least one of their respective back walls, wing walls, or roof panels.

9. A method as recited in claim 6, wherein the lever arm is operably connected to the bottom portion of the back wall.

10. A method as recited in claim 6, wherein the lever arm is operably connected to the bottom portion of the first face surface of the back wall.

* * * * *